United States Patent [19]

Blanc

[11] 4,071,024

[45] Jan. 31, 1978

[54] SNORKEL

[75] Inventor: Max A. Blanc, Bayonne, France

[73] Assignees: Max A. Blanc, Bayonne, France; William B. Anderson, West Palm Beach, Fla.

[21] Appl. No.: 710,189

[22] Filed: July 30, 1976

[51] Int. Cl.[2] ..... A62B 7/00

[52] U.S. Cl. ..... 128/145 A

[58] Field of Search ..... 128/145 A, 145 R, 140 R, 128/142 R, 147, 142.3, 208; 98/80, 67, 63, 64, 65; 138/89.1, 89.2, 89.3, 89.4, 42, 109; 55/456; 114/16 A, 16 D

[56] References Cited

U.S. PATENT DOCUMENTS

| | | | |
|---|---|---|---|
| 2,100,801 | 11/1937 | Green | 98/64 |
| 2,317,237 | 4/1943 | Nilen | 128/145 A |
| 2,362,240 | 11/1944 | Bonilla | 128/145 A |
| 2,461,395 | 2/1949 | Psikal | 55/546 |
| 2,753,865 | 7/1956 | Van der Kogel | 128/145 A |
| 3,147,752 | 9/1964 | Cousteau et al. | 128/147 |

FOREIGN PATENT DOCUMENTS

| | | | |
|---|---|---|---|
| D18,035 | 7/1956 | Germany | 128/145 A |

*Primary Examiner*—Robert W. Michell
*Assistant Examiner*—Henry J. Recla
*Attorney, Agent, or Firm*—Brumbaugh, Graves, Donohue & Raymond

[57] ABSTRACT

A snorkel in which the air intake end of the breathing tube is provided with an air entrapping cap which is in communication with the ambient air through a tortuous air passage defined between the cap and the tube so that when the air intake end of the snorkel is submerged water intake is retarded and water is readily purged by blowing exhalation of the diver.

10 Claims, 4 Drawing Figures

SNORKEL

This invention relates to improvements in snorkels, and particularly to a snorkel in which the air intake end is provided with an air entrapping means which when submerged entraps air at the air intake end of the breathing tube to retard intake of water into the breathing tube and facilitate purging thereof by the exhalation of the diver.

Many snorkel devices have been heretofore proposed for preventing inhalation of water by the diver when the air intake end of the snorkel is submerged. The Wilen U.S. Pat. No. 2,317,237, issued Apr. 20, 1943, for example, discloses a swimmer's mask in which the air inlet end of the breathing tube embodies a float valve which closes automatically to prevent inhalation of water by the diver when the air inlet end of the breathing tube is submerged. A snorkel device of this type functions satisfactorily under ideal conditions in clean, calm water. It must be oriented at all times in an upright position since the float valve will open if the orientation is not maintained, and it may malfunction if dirty water, sand or seaweed prevents proper seating of the float valve.

The snorkel of the present invention is a simple and efficient device without operating parts which permits the snorkel to be submerged while the diver does acrobatic swimming under water during which the submerged snorkel is oriented in different positions without danger of inhalation of water. The snorkel of the present invention provides means for retarding the introduction of water into the breathing tube of the snorkel and for permitting the diver to purge the snorkel of exhaled air and even the smallest amount of water intake simply and at will. The inhalation of purer air reduces diver exhaustion and fatigue and increases his efficiency.

For a complete understanding of the present invention, reference can be made to the detailed description which follows and to the accompanying drawings, in which.

Figures 1, 2, 3, 4:
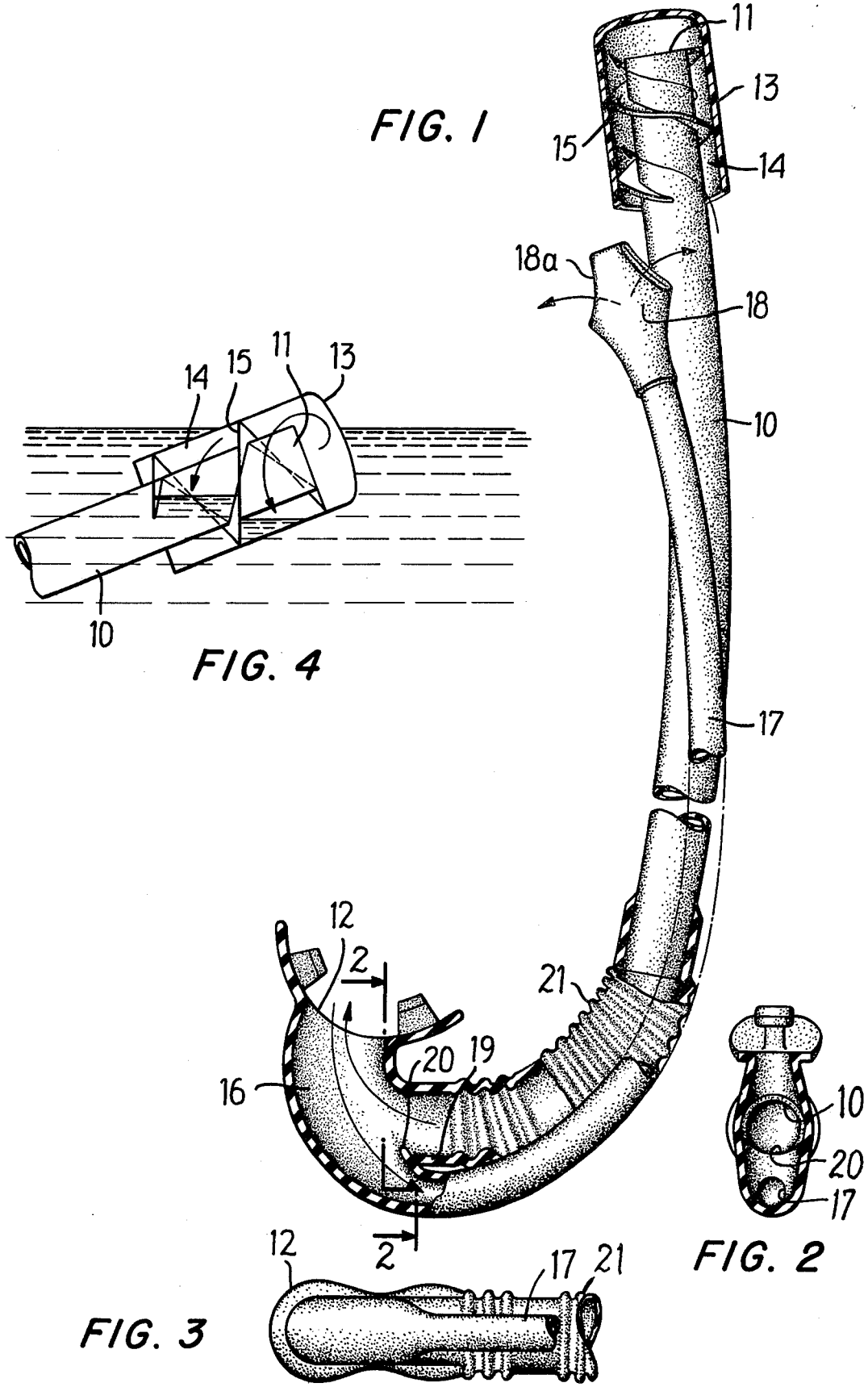
FIG. 1 is a perspective view of the snorkel of the present invention with parts broken away and shown in cross-section.
FIG. 2 is a cross-sectional view taken along the line of 2—2 of FIG. 1 looking in the direction of the arrows.
FIG. 3 is a view of the side of the snorkel opposite the mouthpiece.
FIG. 4 is a view of the air intake end of the snorkel in partially submerged condition.

The snorkel of the present invention includes a breathing tube 10 having an air intake 11 at one end and a mouthpiece 12 at the other end. The air intake end 11 is provided with an air entrapping cap 13 spaced apart from and covering the air intake end and the outer periphery of the breathing tube near the air intake end, so that the air intake end of the breathing tube is in communication with the ambient air through the passage 14 defined between the cap 13 and the outer periphery of the air intake end of the breathing tube. Thus, if the air intake end of the breathing tube is submerged or partially submerged, as shown in FIG. 4, the air entrapped within the cap will prevent inhalation of water by the diver.

To retard the flow of water into the air intake end of the breathing tube and to facilitate purging water therefrom, a tortuous path of flow is provided between the air intake end of the cap and the air intake of the breathing tube by a spiral vane 15 interposed between the outer periphery of the breathing tube and the cap. When the cap 13 is above the water, the spiral passage 14 makes it possible to rid the snorkel of impure exhaled breath automatically and without effort. When the snorkel is wholly or partially submerged the spiral passage retards the intake of water and still permits purging of water and impure air.

As air is inhaled by the diver through the breathing tube, it passes through a chamber 16 adjacent the mouthpiece, and the exhaled air is discharged back into the chamber 16 and purged through a purge tube 17. The purge tube is shorter in length than the breathing tube and the upper discharge end thereof is provided with a one-way flap valve 18. The one-way flap valve is formed by a pair of relatively flat sealed portions made of high grade rubber or other flexible material and provided with a pair of openings **18*a*** through which air and water can be purged by the exhalation of the diver. The valve is normally maintained closed by the water pressure acting against the opposed flat portions of the valve.

The purge tube is separated from the breathing tube at the chamber 16 by a dividing wall 19 having a deflecting lip 20 at the end thereof. The lip 20 deflects fresh air from the breathing tube into the chamber 16 toward the mouthpiece and exhaled air from the chamber 16 into the purge tube. The purge tube is preferably about half the diameter of the breathing tube and of a capacity that will accept approximately half of the exhaled breath of the diver.

The breathing tube is provided with a compressible or collapsible section 21 to enable the breathing tube to be manually closed when the diver desires to purge water and exhaled air from the snorkel. Although the breathing tube is relatively rigid, the compressible section 21, located near the mouthpiece end of the breathing tube, can be readily pinched or collapsed to close it off whenever the diver desires to do so. With the section 21 closed manually by the diver, the diver can readily purge the snorkel of even the smallest amount of water by a brief, sharp exhalation.

The spiral air intake 14 is shown having about 1¾ turns. The cross-sectional area of the passage 14 is preferably about equal to the cross-sectional area of the breathing tube so that the cap does not impede the air intake by the diver.

Although normally the diver will expel about or more than 50% of exhaled air through the purge tube, there are times when the diver will prefer to expel air through the breathing tube, such as when the ambient water pressure around the valve 18 is so high that exhalation of air through the breathing tube is easier. The spiral vane offers no resistance to the discharge of exhaled air.

The snorkel of the present invention permits air and water to be purged both automatically by the breathing and exhalation of the diver and manually by closing of the breathing tube for more thorough purging. It functions satisfactorily even when the diver is making somersaults in the water, and in deeper dives the diver can empty his lungs completely while ascending and immediately breathe through the breathing tube upon surfacing of the spiral vane air intake above the water.

One test performed with the snorkel is to fill it completely with water and let it sink (when not filled it floats) in sixteen feet of water. Taking a deep breath, the diver descends and retrieves the snorkel from the bottom, places the mouthpiece in his mouth, purges the breathing tube with a blast of exhaled air, shuts off the breathing tube by pinching the section 21 and then gives another short exhalation blast to clear the purging tube. While ascending the diver performs a 360° somersault and immediately, upon the spiral passage rising above the water level, breathes through the breathing tube.

The invention has been shown in a single preferred form and by way of example only, and obviously, many variations and modifications may be made therein without departing from the spirit of the invention. The invention, therefore, is not to be limited to any specified form or embodiment, except insofar as such limitations are expressly set forth in the claims.

I claim:

1. A snorkel comprising a breathing tube having an air inlet at one end for admitting air to a diver beneath the surface of the water, inhalation means at the opposite end of the breathing tube to enable the diver to inhale air, air entrapping means at the air inlet to entrap air when the air inlet is submerged, and means defining a tortuous enclosed passage from the ambient air through the air entrapping means to the air inlet to retard the intake of water into the breathing tube while permitting the purging of impure air and water from the snorkel, said tortuous enclosed passage including an air inlet spaced apart from and below the air inlet to the breathing tube, a discharge communicating with the air inlet to the breathing tube and an intermediate enclosed passage forming part of said air entrapping means and winding around the axis of the breathing tube so that air can be freely taken in when the air inlet to the tortuous enclosed passage communicates with air and water can be purged from the tube by exhaled air forced into and entrapped within the discharge end of said tortuous enclosed passage when the air inlet is submerged.

2. A snorkel as set forth in claim 1 in which the air entrapping means includes a cap spaced apart from the air inlet and the outer periphery of the breathing tube near the air inlet to form an opening between the cap and the outer periphery of the breathing tube.

3. A snorkel as set forth in claim 1 in which the tortuous passage is a spiral passage adjacent the air inlet end of the breathing tube connecting the air inlet with the ambient environment.

4. A snorkel as set forth in claim 2 in which the tortuous passage includes a spiral vane interposed between the outer periphery of the tube and the cap to define a spiral air inlet passage to the air inlet.

5. A snorkel as set forth in claim 1 including a purge tube communicating with the inhalation means to enable the diver to purge the snorkel of water.

6. A snorkel as set forth in claim 5 including a one-way flap valve through which said exhaled air is purged from the purge tube, said one-way flap valve being normally maintained closed by ambient pressure.

7. A snorkel as set forth in claim 5 including a compressible section forming part of said breathing tube to permit the diver to close the breathing tube manually while the diver purges the snorkel through the purge tube.

8. A snorkel as set forth in claim 1 in which said inhalation means includes a mouthpiece and including a chamber adjacent said mouthpiece through which inhaled air flows from the breathing tube to the mouthpiece.

9. A snorkel as set forth in claim 8 including a purge tube communicating with said chamber to discharge exhaled air and a valve means in the purge tube for discharging exhaled air and preventing the intake of water.

10. A snorkel as set forth in claim 9 including partition means communicating with said chamber for deflecting air intake from the breathing tube toward the mouthpiece and for deflecting exhaled air from the mouthpiece into the purge tube.

* * * * *